United States Patent [19]

Stewart

[11] 4,010,718

[45] Mar. 8, 1977

[54] RECIPROCATING PISTON ENGINES HAVING PISTON OIL COOLING

[75] Inventor: William Findlay Stewart, Peterborough, England

[73] Assignee: Perkins Engines Limited, Peterborough, England

[22] Filed: Jan. 27, 1975

[21] Appl. No.: 544,530

[30] Foreign Application Priority Data

Feb. 6, 1974 United Kingdom ..... 5374/74

[52] U.S. Cl. ..... 123/41.35; 123/41.36

[51] Int. Cl.² ..... F01P 3/06

[58] Field of Search ..... 123/41.34, 41.35, 41.36, 123/41.39

[56] References Cited

UNITED STATES PATENTS

| | | | |
|---|---|---|---|
| 1,680,883 | 8/1928 | Hosford | 123/41.36 |
| 2,569,103 | 9/1951 | Huber | 123/41.36 |
| 2,966,146 | 12/1960 | Schweitzer | 123/41.35 |
| 2,967,516 | 1/1961 | Stumpfig | 123/41.35 |
| 3,182,642 | 5/1965 | Drtina | 123/41.35 |
| 3,221,718 | 12/1965 | Isley | 123/41.35 |

*Primary Examiner*—Charles J. Myhre
*Assistant Examiner*—Daniel J. O'Connor
*Attorney, Agent, or Firm*—Thomas P. Lewandowski

[57] ABSTRACT

A reciprocating piston engine in which oil cooling is provided by a hollow oil jet assembly located accurately by a location tool and pressed into position in a bore in the crankcase of the engine. Accurately drilled and aligned jet passages are formed in the assembly which is then fitted into position with good accuracy to enable accurate direction of a jet or jets of cooling oil to a desired point or points on the underside of a piston.

6 Claims, 9 Drawing Figures

RECIPROCATING PISTON ENGINES HAVING PISTON OIL COOLING

The present invention relates to cooling of reciprocating engine pistons by streams of oil produced by jets.

It is known to cool the pistons of internal combustion reciprocating engines by directing a stream of lubricating oil at them during the operation of the engine. It is also known to direct a stream of oil into a passage in the piston which leads to a gallery therein.

Hitherto, it has been difficult to direct the stream accurately without resorting to expensive methods of controlling the alignment of the jet.

The present invention has the object of overcoming this drawback.

According to the present invention a reciprocating piston engine comprises a cylinder block having a cylinder therein, a piston reciprocable in the cylinder, a crankcase, a crank rotatable on a bearing in the crankcase, a connecting rod connecting the crank to the piston, a lubricating oil passage in said crankcase, a bore formed in said crankcase between the bearing and said piston and meeting said oil passage, a tubular jet assembly accurately located and held in position in said bore in said block, having a hollow interior connected to said oil passage and a jet passage accurately formed and positioned prior to assembly in said bore.

For a reciprocating engine having a cylinder block, crankcase and reciprocating piston, a method of making a piston cooling system comprises the steps of forming a tubular assembly having a hollow interior, forming a locating surface on the assembly, forming a feed passage and a jet passage in a wall of the assembly and orientated in a particular direction with respect to said assembly, forming a bore in a wall of the crankcase closely adjacent to a cylinder and transverse thereto so that the bore and a lubricating oil feed passage intersects, locating and fastening said assembly in said bore in a precise position relative to said cylinder with the aid of said locating surface and a locating tool.

Preferably the tubular assembly includes two jet passages and the assembly protrudes from both sides of a through bore in a crankcase partition to enable the respective jet passages to be presented to two adjacent cylinders.

Preferably also the assembly is an interface fit in said bore.

Preferably and in the case of a diesel engine the jet passage is so orientated as to project a stream of oil at the part of the underside of the piston crown which is axially aligned with the combustion chamber.

The preferred embodiment of the invention will now be described with reference to the accompanying drawings of which:

Figure 5A:
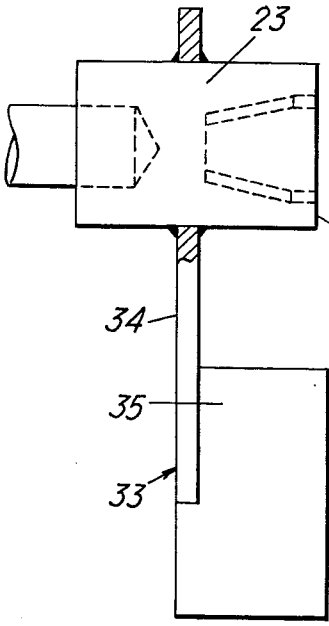
Figure 5B:
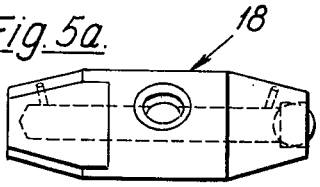

FIGS. 5*a* and 5*b* are views of special tools used for positioning and fixing the oil jet assembly in the engine block or crankcase from the left.

Figure 1:
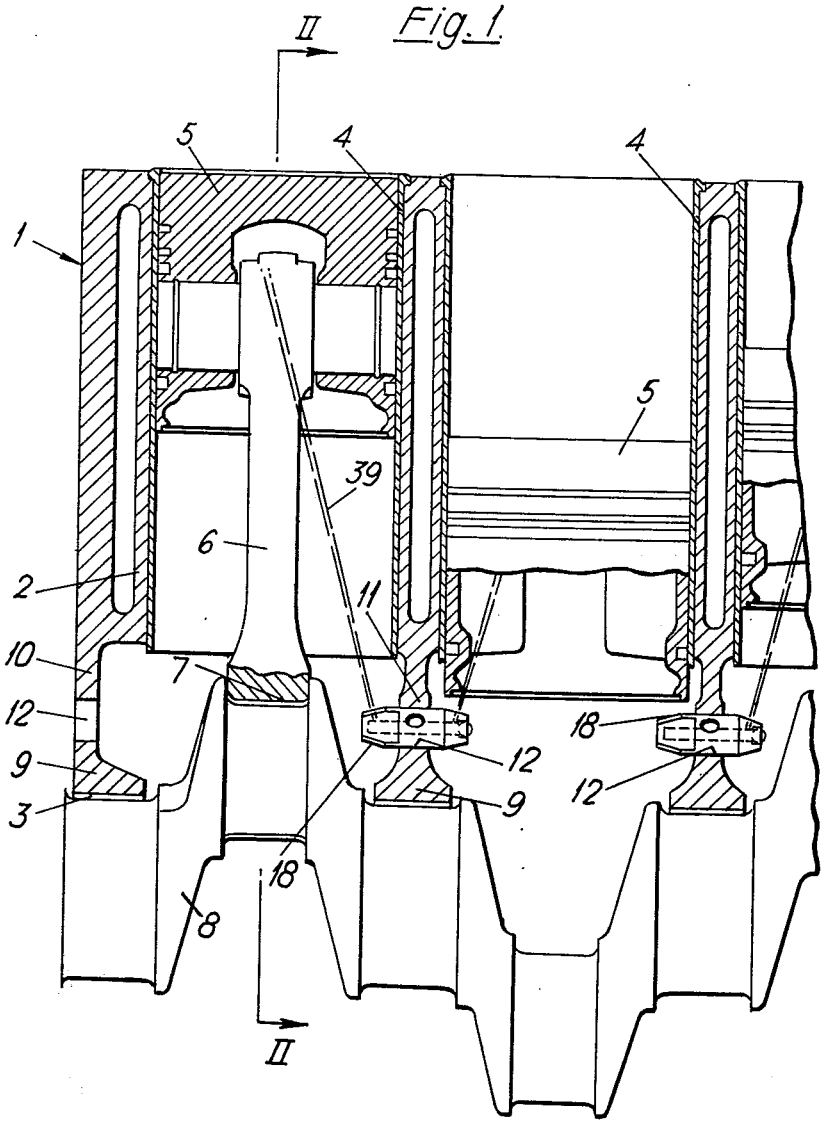
FIG. 1 is a schematic cross section on the center line of a reciprocating piston engine cylinder block and crankcase, two cylinders only being shown.
Figure 2:
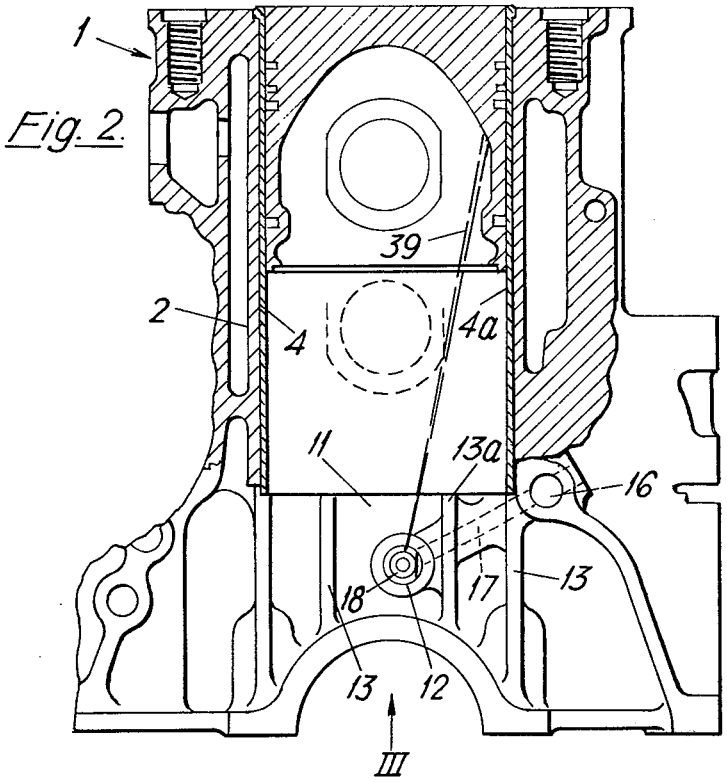
FIG. 2 is a cross section on section II — II end elevation with the piston removed.
Figure 3:
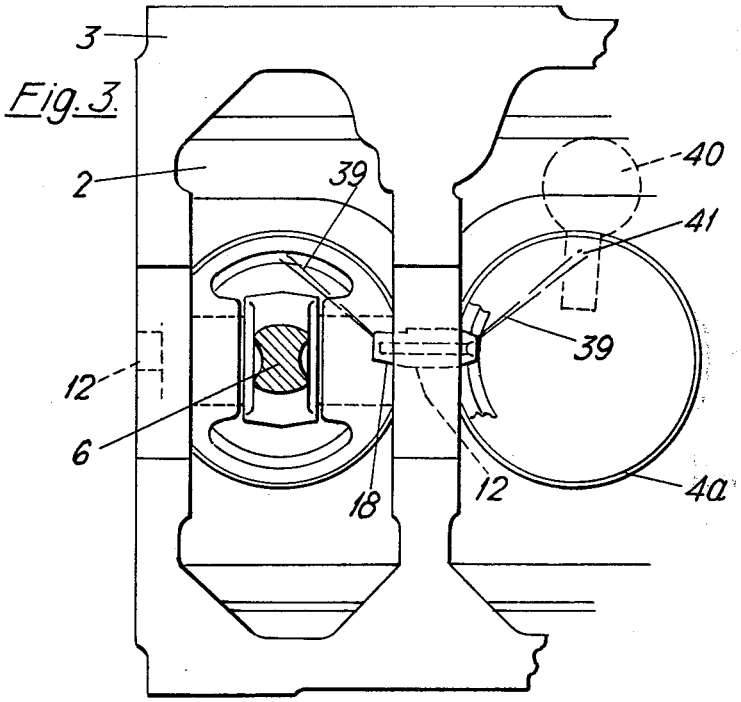
FIG. 3 is a partially cut away elevation from below viewed in the direction of arrow III in FIG. 2.

In FIGS. 1, 2 and 3 there is shown an engine 1 having a cylinder block 2, which in this case is integral with a crankcase 3. Cylinder block 2 accommodates cylinders 4. The cylinder head and sump and other parts have been omitted from these figures for the sake of simplicity, it being understood that the invention applies to the operation of the engine as a whole but not to the omitted parts. Pistons 5 are slidable in the cylinders 4 and are supported by connecting rods 6 themselves pivotted on crank pin bearings 7 in the crankshaft 8. The crankshaft 8 is carried on main bearings 9 in the crankcase 3.

The main bearings 9 are located one at each end of the crankcase 3 and one in between each cylinder 4. The end walls 10 of the crankcase 3 carry the end main bearings 9 and main bearing supports 11 carry the intermediate main bearings 9.

Referring now to FIG. 1, the end walls 10 and bearing supports 11 are bored to form accurately and aligned holes 12. Referring to FIG. 2 it will be seen that reinforcing ribs 13 are formed on wall 11 and one of these 13*a* is closely adjacent one hole 12.

FIG. 2 also shows a main lubricating oil gallery 16. A drilled passage 17 interconnects the gallery 16 with the hole 12.

A jet assembly 18 is shown in FIGS. 4*a* – 4*d*. This consists of a cylinder 19 of metal formed with tapered end portions 20 and 21 and a center cylindrical portion 22. The center portion 22 is such that it is an interference fit in hole 12. The end portion 20 has a flat 25 machined thereon. The cylinder 19 may be formed from stock tube or may simply be bored out, see FIGS. 4*a*, 4*b* and 4*c*, by a central bore 27 which is closed by a ball bearing 28 pressed into place. A side drilling 29 intersects the central bore 27.

Figure 4A:
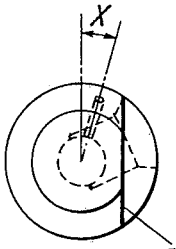
FIG. 4 is subdivided into FIGS. 4*a*, 4*b*, 4*c* and 4*d* and shows the oil jet assembly in left end, side, right end, and lower elevations respectively.
Figure 4B:
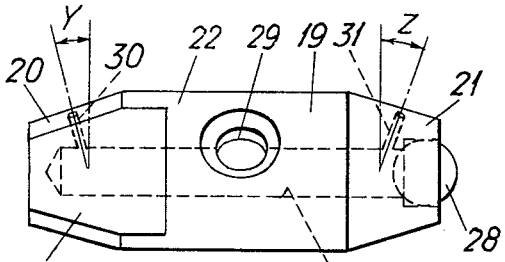
Figure 4C:
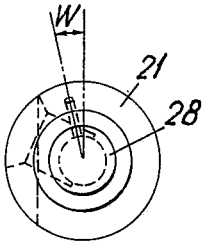
Figure 4D:
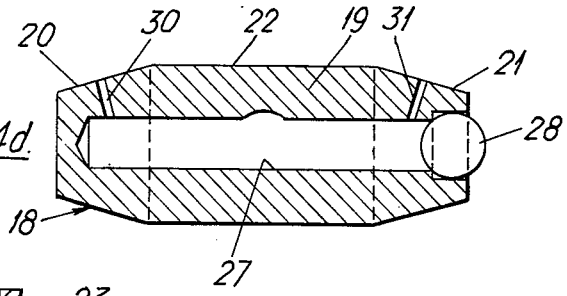

Oil jet holes or jet passages 30 and 31 are formed by placing the jet assembly in a suitable jig and drilling an appropriate size of small hole. The jig is so arranged as to hold the assembly 18 in such a position that the desired angles '*x*' seen in FIG. 4*a* and '*y*' seen in FIG. 4*b* are achieved in the tapered end portion 20. The flat 25 on this portion is important in locating the assembly in the jig. The angles '*w*' and '*z*' seen in FIGS. 4*c* and 4*b* respectively might be different to '*x*' and '*y*' and a different jig would be used to form hole 31 though the size of the two holes 30 and 31 would probably be the same.

The oil jet assembly 18 is then inserted into tool 23. A complementary flat 32 to flat 25 on the interior of the tool 23 ensures that the assembly 18 and tool 23 are in proper relationship. An alignment guage 33 which can be of the form shown in FIGS. 5*a* and 5*b* ensures that the assembly is inserted into hole 12 in its proper angular relation as seen in FIG. 2. The alignment gauge 33 consists of a tab 34 welded to the tool 23 and carrying a semicylindrical shell 35 which is complementary to the bearing 9. Thus the assembly 18 held in fixed relationship to the tool 23 is offered up to the hole 12 in its desired and proper position. Axial pressure applied to the tool 23 drives the assembly into an interference fit in hole 12 to its proper axial position which occurs when the front surface 36 of the tool abuts the wall 11.

After proper assembly the jet holes 30 and 31 are in proper position to direct oil accurately to a desired area on the underside of the piston 5. Also the side drilling 29 is in alignment with connecting oil passage 17.

Figure 5B:
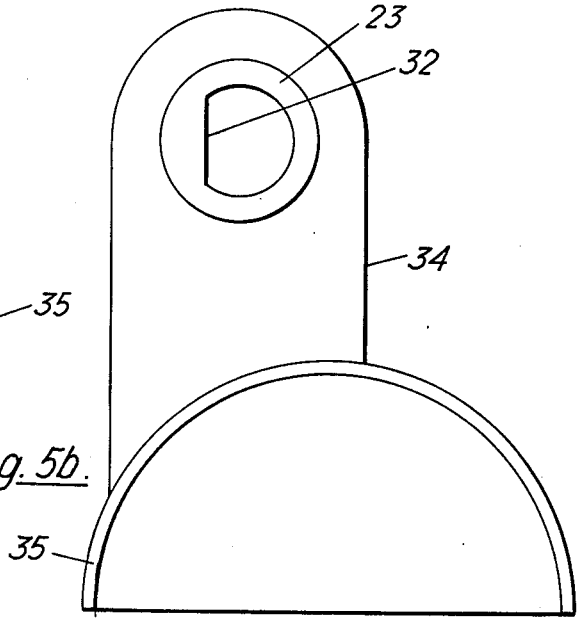

A tool is similar to that shown in FIG. 5 may be used for fitting the assembly in the hole 12 from the other side of the wall 11. It may be necessary to enlarge the hole 12 in the end wall to permit insertion of a tool and assembly from outside the engine. Alternatively various other forms of alignment gauge can be used.

The need for accuracy in directing the jet of cooling oil to a particular point on the underside of a piston is illustrated in FIG. 3 by reference to the right hand cylinder only, where in a diesel engine having an antechamber 40 in the cylinder head the emergence of a stream of hot gas impinges on the crown of the piston 5 at a point 41 before dispersing. This point on the piston crown gets extremely hot and a stream 39 of lubricating oil precisely directed at an opposite point on the underside of the crown is very beneficial in terms of preserving the reliability of the piston. Alternatively, the stream 39 may be directed at an opening leading to a cooling gallery in the piston.

Each piston can receive two cooling jets one from each of the jet assemblies protruding into the corresponding cylinder, though it may be convenient for each of the end cylinders to have only one assembly protruding into it. As a further alternative, more than one pair of jet holes may be formed in the jet assembly so that two or more oil streams are directed at different parts of one piston from one jet assembly.

The alignment gauge 33 suggested herein is exemplary of a number of such gauges which may be preferred.

The invention enables jet assemblies to be made accurately before fitting and enables the jets to avoid the gudgeon pin bosses 42 or other parts of the piston which might otherwise interfere. Further, it enables oil jet assemblies to be incorporated where oil jet cooling might not be possible by conventional means. An example of where it would be extremely difficult to provide oil jet cooling by conventional means is the case of the engine with an integral cylinder head and cylinder block. Moreover the invention enables numerous tests to be carried out on one engine simply by substituting oil jet assemblies. The invention also offers the advantage of enabling a common jet assembly to be used for all of a range of engines, the only distinction being the choice of angles '*w*', '*x*', '*y*', '*z*' or the size of the jet passage or the number of jet passages.

I claim:

1. A reciprocating piston engine comprising a cylinder block having a cylinder therein, a piston reciprocable in the cylinder, a crankcase, a crank rotatable on a bearing in the crankcase, a connecting rod connecting the crank to the piston, a lubricating oil passage in said crankcase, a bore formed in said crankcase between the bearing and said cylinder and meeting said oil passage, a tubular jet assembly, locating means on said jet assembly for accurately positioning said jet assembly within the engine and said jet assembly having an interference fit with said bore to retain said jet assembly's position in said bore in said crankcase, said jet assembly having a hollow interior connected to said oil passage and a jet passage accurately formed and positioned prior to assembly in said bore.

2. An engine as claimed in claim 1 wherein said tubular assembly includes two jet passages and the assembly protrudes from both sides of a through bore in a crankcase partition to enable each jet passage to be presented to one of adjacent cylinders separated by said partition.

3. An engine as claimed in claim 2 wherein at least two jet assemblies provide cooling oil for every piston.

4. An engine as claimed in claim 3 wherein each jet assembly is provided with at least three jet passages, oil from at least two of said passages being directed at one piston.

5. An engine as claimed in claim 1 and particularly in the case of a diesel engine, wherein said jet passage is so orientated as to project a stream of oil at the part of the underside of the piston which is axially aligned with the combustion chamber.

6. An engine as claimed in claim 1 wherein said jet assembly is in an interconnecting wall connecting the crank bearing to the cylinder.

* * * * *